US010048627B2

(12) United States Patent
Sato et al.

(10) Patent No.: US 10,048,627 B2
(45) Date of Patent: Aug. 14, 2018

(54) IMAGE FORMING APPARATUS INCLUDING A CONVEYANCE COVER TURNABLE WITH RESPECT TO A BODY HOUSING

(71) Applicant: KYOCERA Document Solutions Inc., Osaka (JP)

(72) Inventors: Takehiro Sato, Osaka (JP); Yoshiaki Tashiro, Osaka (JP); Koki Morizono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/551,201

(22) PCT Filed: Apr. 4, 2016

(86) PCT No.: PCT/JP2016/060986
§ 371 (c)(1),
(2) Date: Aug. 15, 2017

(87) PCT Pub. No.: WO2016/163328
PCT Pub. Date: Oct. 13, 2016

(65) Prior Publication Data

US 2018/0017913 A1 Jan. 18, 2018

(30) Foreign Application Priority Data

Apr. 6, 2015 (JP) ..... 2015-077745

(51) Int. Cl.
*G03G 15/00* (2006.01)
*G03G 15/23* (2006.01)
(Continued)

(52) U.S. Cl.
CPC ..... *G03G 15/234* (2013.01); *B41J 3/60* (2013.01); *B41J 11/007* (2013.01); *B65H 5/38* (2013.01);
(Continued)

(58) Field of Classification Search
CPC ..... G03G 21/1633; G03G 21/1623; G03G 21/1638
(Continued)

(56) References Cited

U.S. PATENT DOCUMENTS 7,917,062 B2 * 3/2011 Shin et al. ..... G03G 21/1638 399/124
8,087,658 B2 * 1/2012 Ohtsuki ..... G03G 21/1633 399/124
8,442,418 B2 * 5/2013 Koga et al. ..... G03G 21/1633 399/124

FOREIGN PATENT DOCUMENTS

JP 2014-215508 A 11/2014

* cited by examiner

*Primary Examiner* — William J Royer
(74) *Attorney, Agent, or Firm* — Stein IP, LLC

(57) ABSTRACT

This image forming apparatus is equipped with: a conveyance cover which forms a reverse conveyance path; and a double-sided conveyance unit. The conveyance cover is turnably mounted to a body housing, and the double-sided conveyance unit is turnably mounted to the conveyance cover. A side surface of the body housing is equipped with a first abutment surface. The double-sided conveyance unit is equipped with a second abutment surface that abuts on the first abutment surface. The first abutment surface and the second abutment surface are the surfaces against which the double-sided conveyance unit and the surface abut first when the conveyance cover is closed, if in a state where the conveyance cover is opened and the double-sided conveyance unit is separated from the conveyance cover. The abutment presses the double-sided conveyance unit toward a position to cause the conveyance cover to house the double-sided conveyance unit.

8 Claims, 9 Drawing Sheets

(51) Int. Cl.

| | |
|---|---|
| ***B65H 5/38*** | (2006.01) |
| ***B41J 3/60*** | (2006.01) |
| ***B41J 11/00*** | (2006.01) |
| ***G03G 21/16*** | (2006.01) |

(52) U.S. Cl.
CPC ..... *G03G 21/1633* (2013.01); *G03G 15/6508* (2013.01); *G03G 15/6511* (2013.01); *G03G 2215/00396* (2013.01); *G03G 2215/00586* (2013.01); *G03G 2215/00679* (2013.01)

(58) Field of Classification Search
USPC ..... 399/107, 110, 124
See application file for complete search history.

IMAGE FORMING APPARATUS INCLUDING A CONVEYANCE COVER TURNABLE WITH RESPECT TO A BODY HOUSING

CROSS-REFERENCE TO RELATED APPLICATIONS

This application is a national stage of International Application No. PCT/JP2016/060986, filed Apr. 4, 2016, which claims the benefit of priority to Japanese Application No. 2015-077745, filed Apr. 6, 2015, in the Japanese Patent Office, the disclosures of which are incorporated herein in their entireties by reference.

TECHNICAL FIELD

The present invention relates to an image forming apparatus including a conveyance cover turnable with respect to a body housing and a conveyance unit turnably mounted to the conveyance cover.

BACKGROUND ART

An image forming apparatus such as a printer, a copier, or a facsimile machine is provided with a sheet conveyance path in a body housing, for conveying a sheet on which an image forming process is performed. In general, the sheet conveyance path includes a main conveyance path for conveying the sheet from a sheet feeding unit to a sheet discharge portion via an image forming unit, and a reverse conveyance path for conveying the sheet back to an upstream side of the image forming unit when performing double-sided printing. In a general image forming apparatus, the sheet conveyance path is disposed near a side surface of the body housing, and a conveyance cover having a conveyance guide surface on an inner wall surface side is turnably mounted to the body housing so that the sheet conveyance path can be opened. Further, the double-sided conveyance unit may be incorporated in the conveyance cover in a turnably supported manner. The double-sided conveyance unit has a guide surface constituting a part of the main conveyance path and the reverse conveyance path (see, for example, Patent Document 1).

When a sheet jam occurs in the sheet conveyance path, the conveyance cover is opened. This opening exposes most parts of the main conveyance path, and a user can easily perform jam handling. In addition, when a sheet jam occurs in the reverse conveyance path, the double-sided conveyance unit is turned with respect to the conveyance cover, and the reverse conveyance path is opened. When the jam handling is finished, the user closes the double-sided conveyance unit and the conveyance cover.

LIST OF CITATIONS

Patent Literature

Patent Document 1: JP-A-2014-215508

SUMMARY OF THE INVENTION

Technical Problem

In the structure described above, the conveyance cover has a pivot axis with respect to the body housing, and the double-sided conveyance unit has a pivot axis with respect to the conveyance cover. When two pivot axes exist separately in this way, a movement locus of the double-sided conveyance unit becomes at random. Therefore, structural design for avoiding interference between the double-sided conveyance unit and other members becomes difficult, and as a result, freedom in design of the sheet conveyance path and its peripheral portions is restricted.

It is an object of the present invention to improve freedom in design of an image forming apparatus, by restricting a moving range of a conveyance unit in the image forming apparatus equipped with a conveyance cover turnable with respect to a body housing and a conveyance unit turnably mounted to the conveyance cover.

Means for Solving the Problem

An image forming apparatus according to a first aspect of the present invention to achieve the above object includes: an image forming unit configured to form an image on a sheet; a sheet conveyance path constituted of a first wall and a second wall disposed to face each other with a predetermined space therebetween, so as to convey the sheet in a vertical direction; a body housing configured to house the image forming unit and the sheet conveyance path, and to have a side surface to be an access surface when the sheet conveyance path is opened to the outside; a conveyance cover having an outer wall surface and an inner wall surface, turnably mounted to the body housing on the side surface, including a first guide wall surface constituting at least a part of the first wall on the inner wall surface side, so that attitude thereof is switchable between a closed state in which the sheet conveyance path is closed and an opened state in which the sheet conveyance path is opened to the outside; and a conveyance unit disposed on the inner wall surface side of the conveyance cover and turnably mounted to the conveyance cover, including a second guide wall surface constituting at least a part of the second wall, so that attitude thereof is switchable between a normal state in which the second guide wall surface faces the first guide wall surface with a predetermined space therebetween to form at least a part of the sheet conveyance path, and a separated state in which the second guide wall surface is separated from the first guide wall surface. The side surface of the body housing is provided with a first abutment surface, the conveyance unit is provided with a second abutment surface capable of abutting the first abutment surface, and in a state where the conveyance cover is in the opened state and the conveyance unit is in the separated state, when an operation of switching the conveyance cover to the closed state is performed, the conveyance unit and the side surface abut each other first with the first abutment surface and the second abutment surface, and by this abutment the conveyance unit is pressed to move toward the normal state.

According to this image forming apparatus, in the state where the conveyance cover is in the opened state and the conveyance unit is in the separated state, when the user performs the operation of switching the conveyance cover to the closed state with respect to the body housing, the second abutment surface of the conveyance unit, prior to other portions, abuts the first abutment surface provided to the side surface of the body housing. Then, by this abutment, the conveyance unit is pressed to move toward the normal state. In other words, by the pressure described above, the conveyance unit is pushed back to the normal position (normal state) in the conveyance cover. In this way, the user can easily perform the operation of switching the conveyance cover to the closed state. In view of designing the apparatus, in any state of the conveyance unit with respect to the conveyance cover, the pressure described above when the conveyance cover is switched from the opened state to the closed state corrects the state of the conveyance unit to move toward the normal state, and hence the randomness of the movement locus of the conveyance unit can be eliminated. In this way, freedom in design of the sheet conveyance path and its peripheral portion can be easily secured.

Advantageous Effects of the Invention

According to the present invention, in the image forming apparatus including the conveyance cover turnable with respect to the body housing, and the conveyance unit turnably mounted to the conveyance cover, the moving range of the conveyance unit is restricted. Therefore, user's operability of the conveyance cover can be improved, and freedom in design of the image forming apparatus can be enhanced.

DESCRIPTION OF EMBODIMENTS

Figure 1:
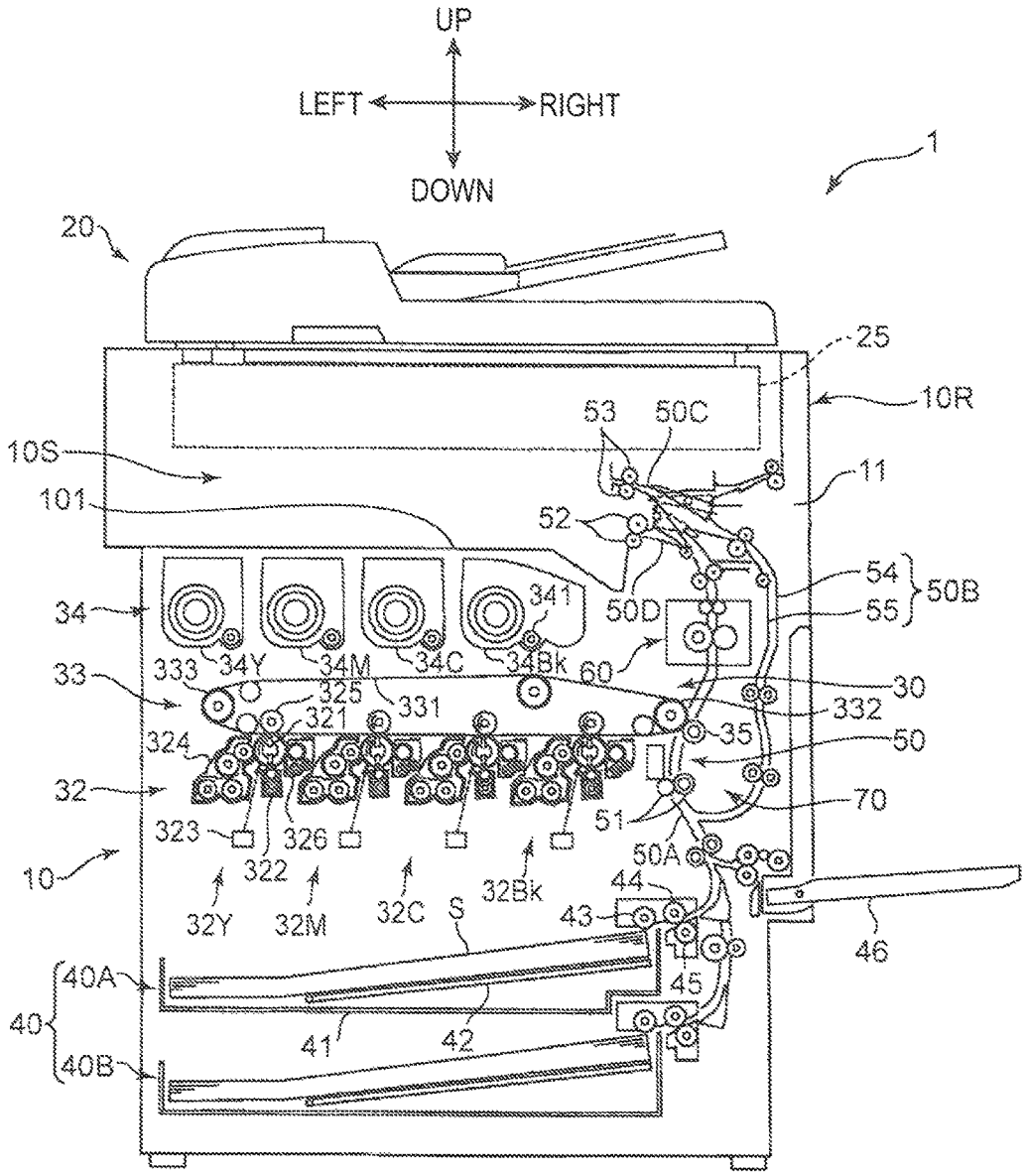
FIG. 1 is a schematic vertical cross-sectional view of an image forming apparatus according to an embodiment of the present invention.

Hereinafter, with reference to the drawings, embodiments of the present invention are described in detail. FIG. 1 is a cross-sectional view illustrating an internal structure of an image forming apparatus 1 according to an embodiment of the present invention. In this description, a full color multifunction peripheral having a printer function and a copy function is exemplified as the image forming apparatus 1, but the image forming apparatus may be a printer, a copier, or a facsimile apparatus.

The image forming apparatus 1 includes a body housing 10 having a casing structure and an automatic document feeder (ADF) 20 disposed on the body housing 10. Inside the body housing 10, there are housed a reader unit 25 that optically reads a document image to be copied, an image forming unit that forms an image on a sheet, a sheet feeding unit 40 that stores sheets, and a conveyance path 50 that conveys the sheet from the sheet feeding unit 40 or a manual feed tray 46 to a discharge space 10S via an image forming portion 30 and a fixing portion 60. The image forming unit includes the image forming portion 30 that forms a toner image on the sheet, and the fixing portion 60 that fixes the toner image to the sheet. Sheets S discharged to the discharge space 10S are stacked on a sheet discharge portion 101.

The ADF 20 automatically feeds document sheets to be copied to a predetermined document reading position in the body housing 10. The reader unit 25 optically reads an image of the document sheet automatically fed by the ADF 20 on the upper surface of the body housing 10 or a document sheet placed manually.

The image forming portion 30 generates a full color toner image and transfers the toner image onto the sheet so as to form the image on the sheet, and includes an image forming unit 32 including tandem-arranged four image forming units 32Y, 32M, 32C, and 32Bk, which form yellow (Y), magenta (M), cyan (C), and black (Bk) toner images, an intermediate transfer unit 33 disposed just above the image forming unit 32, and a toner replenishment portion 34 disposed above the intermediate transfer unit 33.

Each of the image forming units 32Y, 32M, 32C, and 32Bk includes a photosensitive drum 321, and includes a charger 322, an exposure 323, a developing device 324, a primary transfer roller 325, and a cleaning device 326, which are disposed around the photosensitive drum 321.

The photosensitive drum 321 rotates about its axis, and an electrostatic latent image and a toner image are formed on a circumference surface thereof. The charger 322 uniformly charges the surface of the photosensitive drum 321. The exposure 323 includes a laser light source and optical devices such as a mirror and a lens, and irradiates the circumference surface of the photosensitive drum 321 with light based on image data of the document image so as to form the electrostatic latent image. The developing device 324 supplies toner to the circumference surface of the photosensitive drum 321 so as to develop the electrostatic latent image formed on the photosensitive drum 321. The primary transfer roller 325 primarily transfers the toner image on the photosensitive drum 321 to an intermediate transfer belt 331. The cleaning device 326 cleans the circumference surface of the photosensitive drum 321 after the toner image is transferred.

The intermediate transfer unit 33 includes the intermediate transfer belt 331, a belt drive roller 332, and a driven roller 333. A plurality of toner images from the photosensitive drums 321 are transferred to the same position on the outer circumference surface of the intermediate transfer belt 331 in a superimposed manner. The intermediate transfer belt 331 is turned in a counterclockwise direction in FIG. 1. A secondary transfer roller 35 is disposed to face a circumference surface of the belt drive roller 332. A nip between the belt drive roller 332 and the secondary transfer roller 35 becomes a secondary transfer portion for transferring the full color toner image superimposed on the intermediate transfer belt 331 to the sheet.

The toner replenishment portion 34 includes a yellow toner container 34Y, a magenta toner container 34M, a cyan toner container 34C, and a black toner container 34Bk, which respectively supply individual color toners to the developing devices 324 of the image forming units 32Y, 32M, 32C, and 32Bk of individual colors from discharging screws 341 via not shown supply paths.

The sheet feeding unit 40 includes two paper feed cassettes 40A and 40B for storing the sheets S on which the image forming process is performed. The paper feed cassette 40A (40B) includes a sheet storing portion 41 for storing a bunch of sheets, in which the sheets S are stacked, and a lift plate 42 for lifting the bunch of sheets for sheet feeding. A pickup roller 43 and a roller pair of a sheet feed roller 44 and a retard roller 45 are disposed above the right end side of the paper feed cassette 40A (40B). When the pickup roller 43 and the sheet feed roller 44 are driven, the bunch of sheets in the paper feed cassette 40A are sent out one by one from the top sheet S and are conveyed to an upstream end of the conveyance path 50.

The conveyance path 50 includes a main conveyance path 50A for conveying the sheet S from the sheet feeding unit 40 to an outlet of the fixing portion 60 via the image forming portion 30, a reverse conveyance path 50B for conveying the sheet S having one side printed back to an upstream side of the image forming portion 30 when performing double-sided printing, and an upper discharge path 50C and a lower discharge path 50D for guiding the sheet S from a downstream end of the main conveyance path 50A to the discharge space 10S. The main conveyance path 50A and the reverse conveyance path 50B are disposed near the right side surface of the body housing 10 and are sheet conveyance paths that convey the sheet in a substantially vertical direction.

A registration roller pair 51 is disposed on the upstream side of the secondary transfer portion in the main conveyance path 50A. The sheet S is temporarily stopped by the registration roller pair 51 in a standstill state so that skew correction is performed. After that, at a predetermined timing for image transfer, the registration roller pair 51 is driven to rotate by a drive motor (not shown), and hence the sheet S is sent out to the secondary transfer roller 35.

The fixing portion 60 performs a fixing process on the sheet S to fix the toner image. The fixing portion 60 includes a fixing housing 60H, and a heating roller 61 and a pressure roller 62 that form a fixing nip (see FIG. 3). When the sheet S passes through the fixing nip, the toner image transferred to the sheet S is fixed to the sheet.

The main conveyance path 50A above the fixing portion 60 is provided with a not shown switching guide in a manner capable of swinging. When the switching guide swings to one position, the sheet S is sent to the lower discharge path 50D from the main conveyance path 50A. Then, the sheet S is discharged to the sheet discharge portion 101 by a first discharge roller pair 52. On the other hand, when the switching guide swings to an other position, the sheet S is sent to the upper discharge path 50C from the main conveyance path 50A. After that, the sheet S is discharged to the sheet discharge portion 101 by a second discharge roller pair 53. When the double-sided printing is performed on the sheet S, in a state where the front end of the sheet S whose one side has a formed image is exposed from the upper discharge path 50C to the discharge space 10S, the rotation direction of the second discharge roller pair 53 is reversed, and hence the sheet S is switched back. Then, the rear end of the sheet S that has been stopped near a boundary between the upper discharge path 50C and the reverse conveyance path 50B becomes a new front end to be conveyed to the reverse conveyance path 50B.

A right side surface 10R (side surface) of the body housing 10 is a side surface to be an access surface for opening the main conveyance path 50A and the reverse conveyance path 50B to the outside when a sheet jam or the like has occurred. Each of the main conveyance path 50A and the reverse conveyance path 50B is formed of a pair of wall surfaces facing each other with a predetermined space therebetween. FIG. 1 illustrates that the reverse conveyance path 50B is formed of an outer side first wall 54 and an inner side second wall 55 facing the first wall 54 with a space therebetween.

The right side surface 10R is provided with a conveyance cover 11 that can be opened with respect to the body housing 10 in order that the above-mentioned access can be performed. In addition, a double-sided conveyance unit 70 (conveyance unit) is disposed on the inner side of the conveyance cover 11 near the right side surface of the body housing 10.

Figure 2:
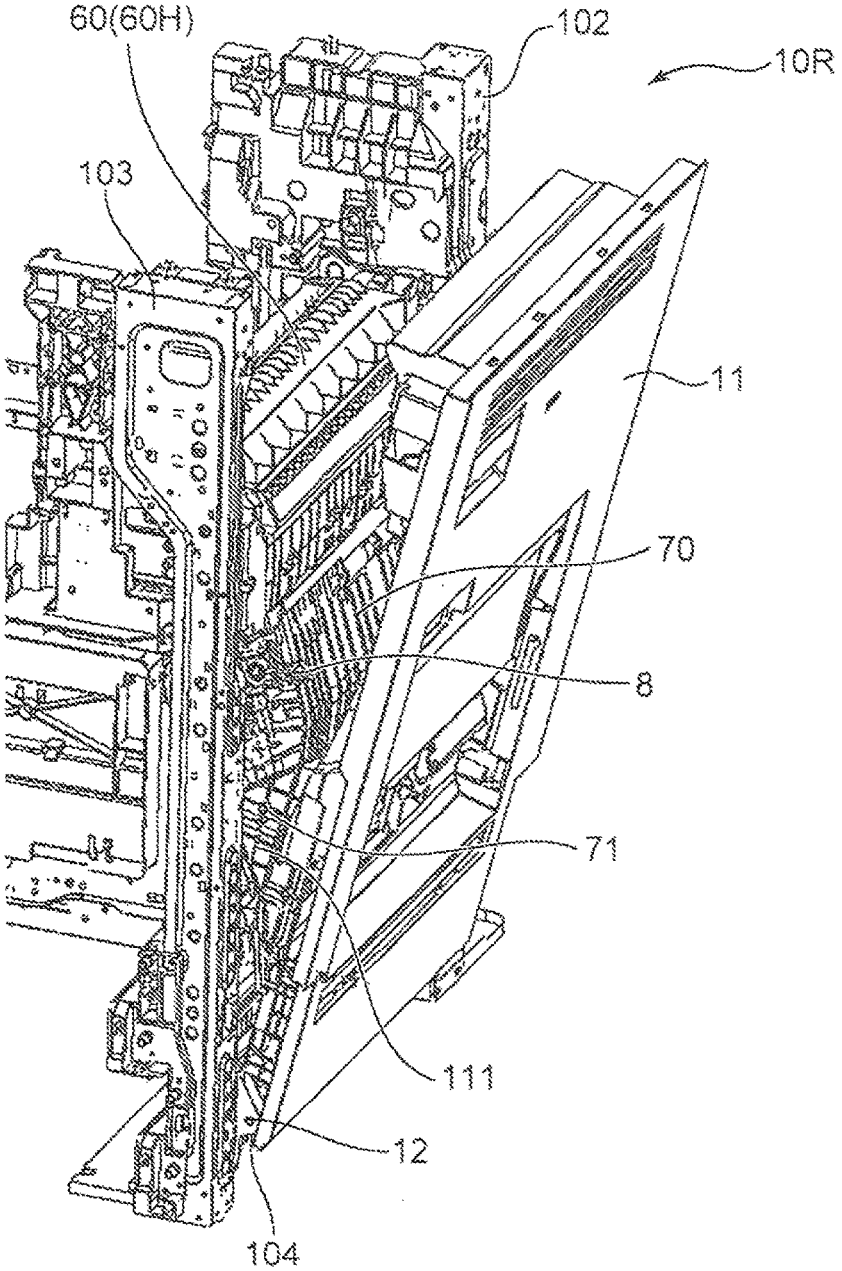
FIG. 2 is a perspective view illustrating a state where a conveyance cover of the image forming apparatus is opened.
Figure 3:
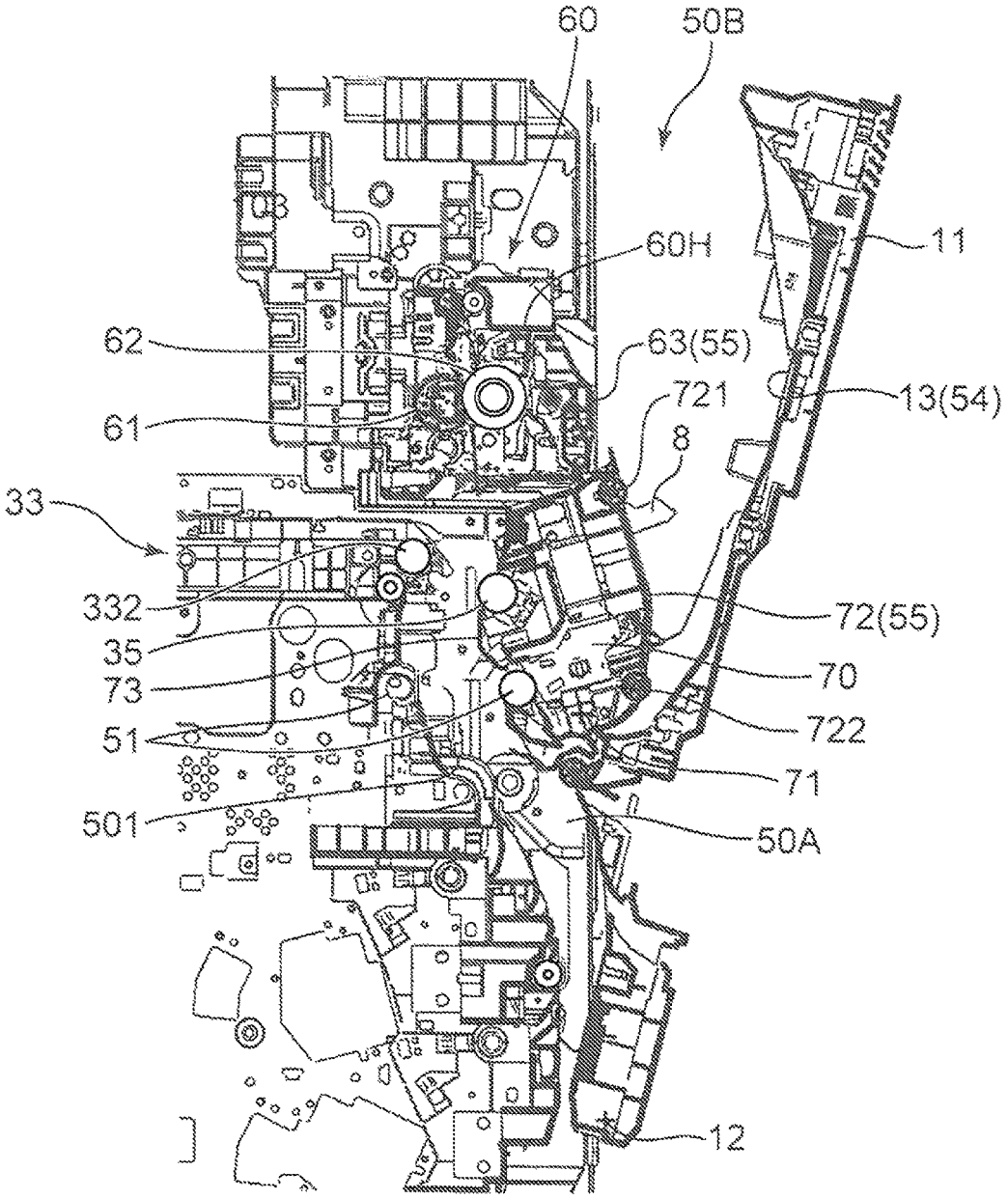
FIG. 3 is a cross-sectional view illustrating a part of a body housing, the conveyance cover in an opened state and a conveyance unit in a separated state.
Figure 4:
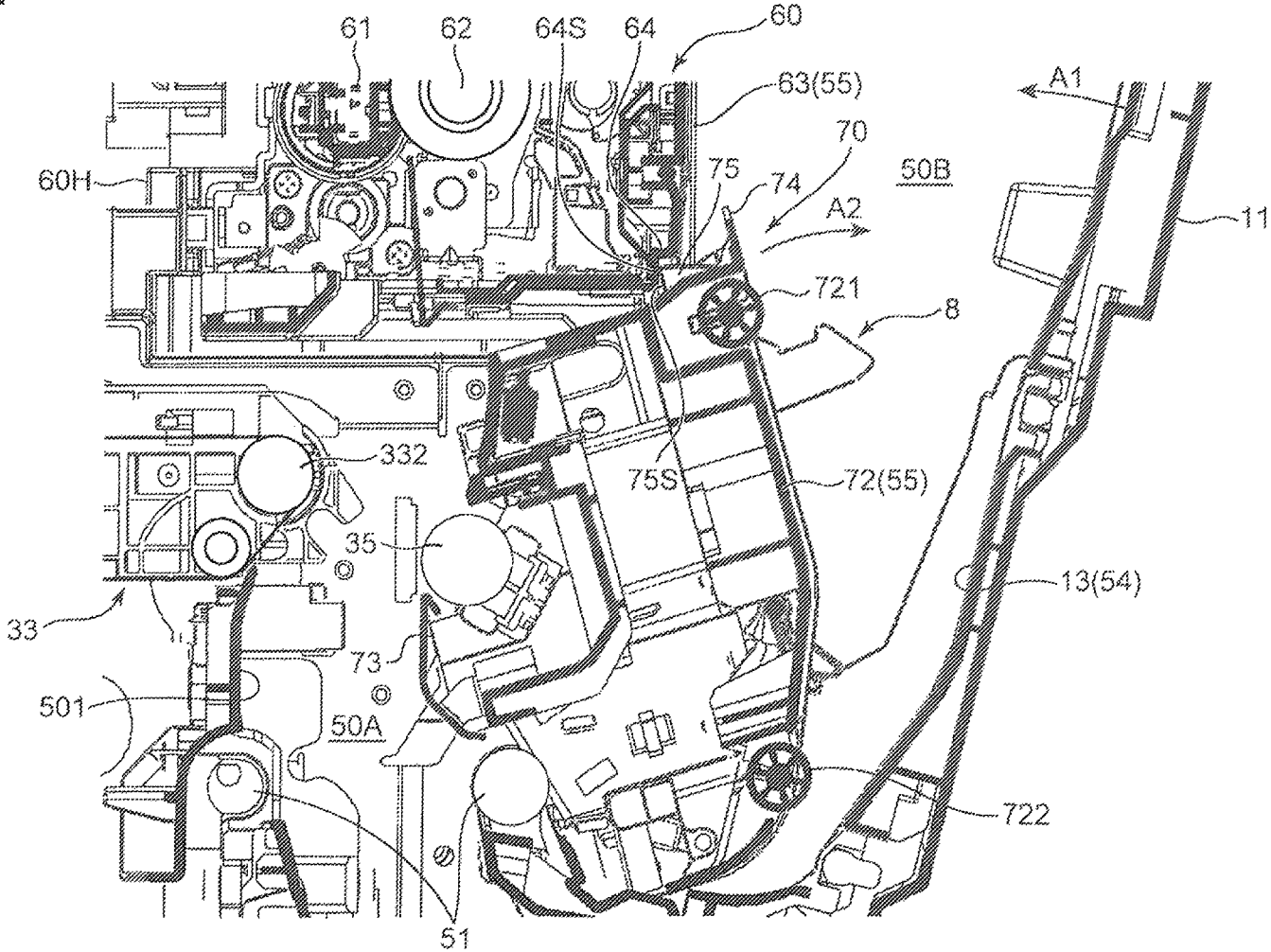
FIG. 4 is a main part enlarged view of FIG. 3.

The conveyance cover 11 and the double-sided conveyance unit 70 are described in detail. FIG. 2 is a perspective view illustrating a state where the conveyance cover 11 is opened with respect to the body housing 10. FIG. 3 is a cross-sectional view illustrating a part of the body housing 10, the conveyance cover 11, and the double-sided conveyance unit 70. FIG. 4 is a main part enlarged view of FIG. 3. The conveyance cover 11 has a first support shaft 12 turnably supported at the lower part by the body housing 10. On the other hand, the double-sided conveyance unit 70 has a second support shaft 71 (second fulcrum) turnably supported at the lower part by the conveyance cover 11 at a position higher than the first support shaft 12.

The conveyance cover 11 is a rectangular member having a size occupying most part of the right side surface 10R, and has an outer wall surface to be an outside surface of the right side surface 10R of the image forming apparatus 1, and an inner wall surface facing the inside space of the body housing 10. The manual feed tray 46 is disposed near the middle in the vertical direction of the outer wall surface (not shown in FIGS. 2 and 3). On the inner wall surface side of the conveyance cover 11, a first guide wall surface 13 is formed to constitute substantially the entire area of the first wall 54 (at least a part of the first wall) of the reverse conveyance path 50B.

The first support shaft 12 is turnably supported by support boss portions 104 (first fulcrum) formed to protrude near the lower ends of rear right and front right vertical frames 102 and 103 (FIG. 2) of the body housing 10. The conveyance cover 11 turns about the first support shaft 12 and can be switched between a closed state in which the main conveyance path 50A and the reverse conveyance path 50B are closed, and an opened state in which these conveyance paths are opened to the outside. FIG. 2 illustrates the opened state of the conveyance cover 11.

The double-sided conveyance unit 70 is disposed on the inner wall surface side of the conveyance cover 11. The second support shaft 71 of the double-sided conveyance unit 70 is turnably supported by support plates 111 formed to protrude on the front end and the rear end of the conveyance cover 11. The double-sided conveyance unit 70 is a structure having a substantially elliptical shape in a side view, and includes a second guide wall surface 72 on the right side surface and a third guide wall surface 73 on the left side surface.

The second guide wall surface 72 constitutes a lower part of the second wall 55 of the reverse conveyance path 50B (at least a part of the second wall). Note that an upper part of the second wall 55 is constituted of a right side wall 63 of the fixing housing 60H. Conveyance rollers 721 and 722 for conveying the sheet in the reverse conveyance path 50B are assembled to the second guide wall surface 72. The third guide wall surface 73 is disposed to face a fourth guide wall surface 501 disposed on the body housing 10 side with a predetermined space therebetween so as to form the main conveyance path 50A. The third guide wall surface 73 is provided with one roller of the registration roller pair 51 and the secondary transfer roller 35.

The double-sided conveyance unit 70 can turn about the second support shaft 71 with respect to the conveyance cover 11, and hence attitude thereof can be switched between a normal state and a separated state. FIGS. 2 to 4 illustrate the separated state of the double-sided conveyance unit 70. In the normal state, the second guide wall surface 72 faces the first guide wall surface 13 of the conveyance cover 11 with a predetermined space therebetween so as to form a lower part of the reverse conveyance path 50B. In the separated state, the second guide wall surface 72 is separated from the first guide wall surface 13 so that the reverse conveyance path 50B is opened.

In the closed state of the conveyance cover 11, the double-sided conveyance unit 70 is naturally in the normal state. In this case, the second guide wall surface 72 and the first guide wall surface 13 face each other with a predetermined space therebetween, while the third guide wall surface 73 and the fourth guide wall surface 501 face each other with a predetermined space therebetween. On the other hand, in the opened state of the conveyance cover 11, the double-sided conveyance unit 70 can be any one of the normal state and the separated state. In the normal state of the double-sided conveyance unit 70 the user can easily handle a jammed sheet generated in the main conveyance path 50A, while in the separated state of the same the user can easily handle a jammed sheet generated in the reverse conveyance path 50B. The user can switch the attitudes of the double-sided conveyance unit 70 by grasping a handle 74 disposed at an upper end of the double-sided conveyance unit 70. conveyance unit 70 by grasping a handle 74 disposed at an upper end of the unit.

As described above, in this embodiment, the conveyance cover 11 has the first fulcrum (first support shaft 12) for turning with respect to the body housing 10, and the double-sided conveyance unit 70 has the second fulcrum (second support shaft 71) for turning with respect to the conveyance cover 11. When two pivot axes exist separately in this way, a movement locus of the double-sided conveyance unit 70 becomes at random. Specifically, in the opened state of the conveyance cover 11, the movement locus of the double-sided conveyance unit 70 when the conveyance cover 11 is switched to the closed state is different between the case where the double-sided conveyance unit 70 is in the normal state and the case where the same is in the separated state. It is difficult to design a structure that allows a random behavior of the double-sided conveyance unit 70 when the conveyance cover 11 is opened and closed while avoiding interruption (collision) between the double-sided conveyance unit 70 and other members on the right side surface 10R of the body housing 10. As a result, freedom in design of the main conveyance path 50A, the reverse conveyance path 50B, and their peripheral portions is restricted.

In order to solve the above-mentioned problem, the image forming apparatus 1 of this embodiment has a mechanism in which when the conveyance cover 11 is switched from the opened state to the closed state, even if the double-sided conveyance unit 70 is in a state other than the normal state, the double-sided conveyance unit 70 is pushed back to the normal state interlocking with the closed state of the conveyance cover 11. This mechanism is constituted of a first abutment surface 64S disposed on a right side surface 10R side of the body housing 10 and a second abutment surface 75S disposed on a conveyance cover 11 side so that it can abut the first abutment surface 64S.

Figure 5A:
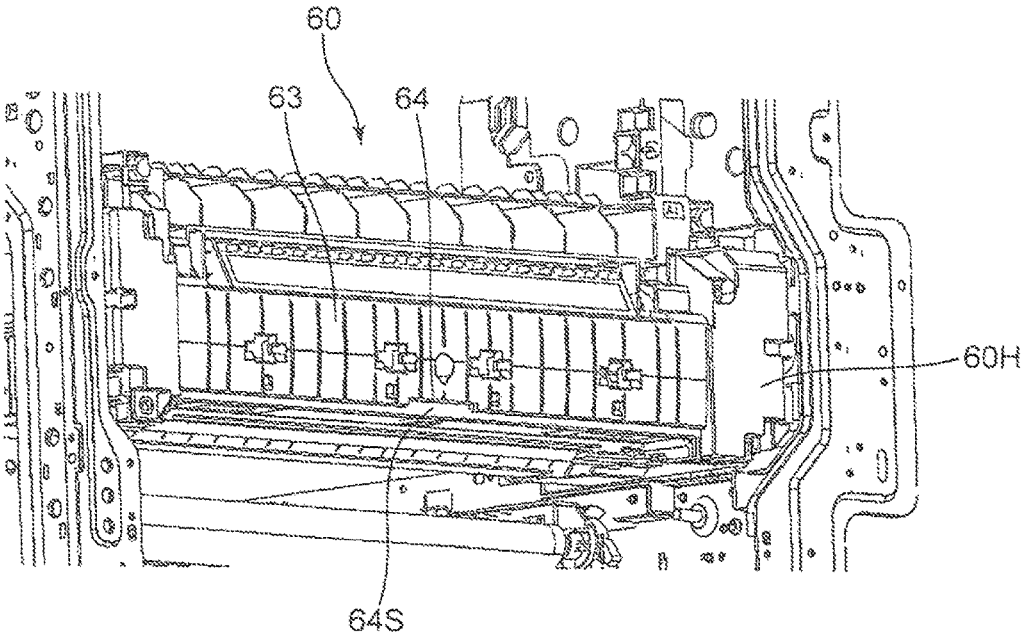
FIG. 5A is a perspective view illustrating a first abutment surface provided to a body housing side.
Figure 5B:
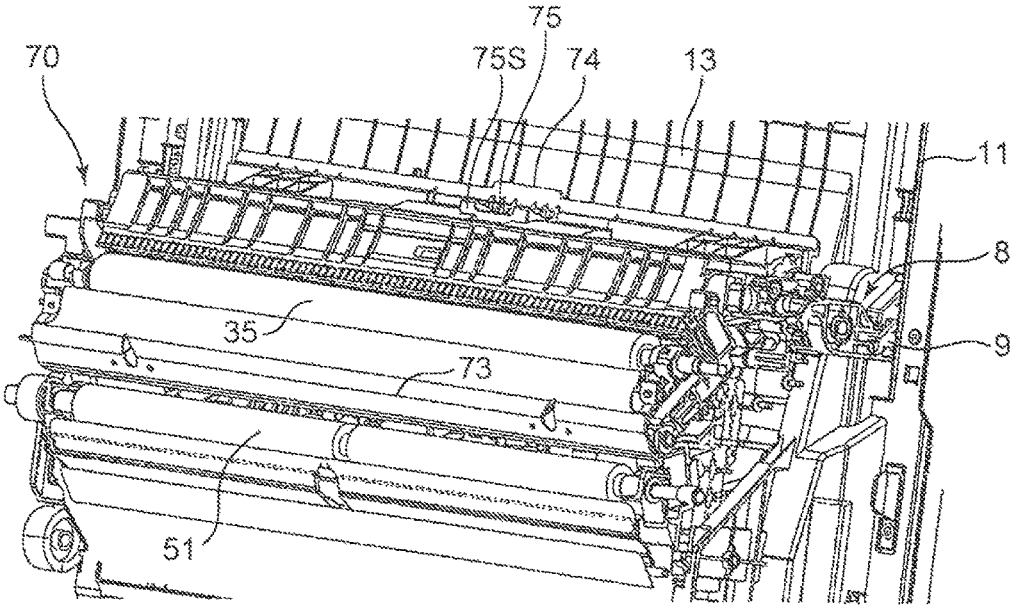
FIG. 5B is a perspective view illustrating a second abutment surface provided to a conveyance unit side.

FIG. 5A is a perspective view illustrating the first abutment surface 64S, and FIG. 5B is a perspective view illustrating the second abutment surface 75S. The first abutment surface 64S is disposed on the right side wall 63 of the fixing housing 60H in this embodiment. As described above, the right side wall 63 constitutes the upper part of the second wall 55 as a guide wall for the sheet to be reversely conveyed, and the first abutment surface 64S is a bottom surface of a recess 64 formed by recessing a part of the right side wall 63 to the left. The first abutment surface 64S is disposed at a lower end of the right side wall 63 in the middle in a width direction (front and rear direction) or its vicinity. The first abutment surface 64S is parallel to the right side surface 10R of the body housing 10 and faces the right direction.

The second abutment surface 75S is formed on a protrusion 75 disposed near the middle in the width direction (front and rear direction) of the upper surface (upper part) of the double-sided conveyance unit 70. The second abutment surface 75S is a flat abutment surface parallel to the right side surface 10R and faces the left direction when the double-sided conveyance unit 70 is in the normal state. The first abutment surface 64S described above is a flat reception surface with which the second abutment surface 75S as the flat abutment surface can make surface contact. With the flat abutment surface and the flat reception surface, it is possible to prevent impact force from being concentrated locally when the first abutment surface 64S and the second abutment surface 75S abut each other, and hence breakage thereof due to the abutment can be prevented.

In the state where the conveyance cover 11 is in the opened state and the double-sided conveyance unit 70 is in the separated state, when an operation of switching the conveyance cover 11 to the closed state as illustrated by an arrow A1 in FIG. 4, the double-sided conveyance unit 70 and a member existing on the right side surface 10R of the body housing 10 abut each other first at the first abutment surface 64S and the second abutment surface 75S. FIG. 4 illustrates the state where the first abutment surface 64S and the second abutment surface 75S have just abutted each other. By this abutment, the double-sided conveyance unit 70 is pressed in the direction shown by an arrow A2. By this pressure, the double-sided conveyance unit 70 turns about the second support shaft 71 in a clockwise direction and moves toward the normal state. Note that even if the double-sided conveyance unit 70 is in a state other than in the separated state (including the normal state), i.e. even if the double-sided conveyance unit 70 is in any state, the first abutment surface 64S and the second abutment surface 75S abut each other first.

According to the image forming apparatus 1 of this embodiment, in the state where the conveyance cover 11 is in the opened state and the double-sided conveyance unit 70 is in the separated state, when the user performs the operation of switching the conveyance cover 11 to the closed state with respect to the body housing 10, prior to other parts, the second abutment surface 75S of the double-sided conveyance unit 70 abuts the first abutment surface 64S on the body housing 10 side. Then, by this abutment the double-sided conveyance unit 70 is pressed to move toward the normal state. The normal state is, so to speak, a normal position of the double-sided conveyance unit 70, which is embraced by the inner wall surface side of the conveyance cover 11. By the pressure described above, the double-sided conveyance unit 70 is pushed back to the normal position.

In this way, the user can easily perform the operation of switching the conveyance cover 11 to the closed state. In view of designing the apparatus, in any state of the double-sided conveyance unit 70 with respect to the conveyance cover 11, the pressure described above when the conveyance cover 11 is switched from the opened state to the closed state corrects the state of the double-sided conveyance unit 70 to move toward the normal state, and hence the randomness of the movement locus of the double-sided conveyance unit 70 can be eliminated. In this way, freedom in design of the main conveyance path 50A, the reverse conveyance path 50B, and their peripheral portions can be easily secured.

Figure 6:
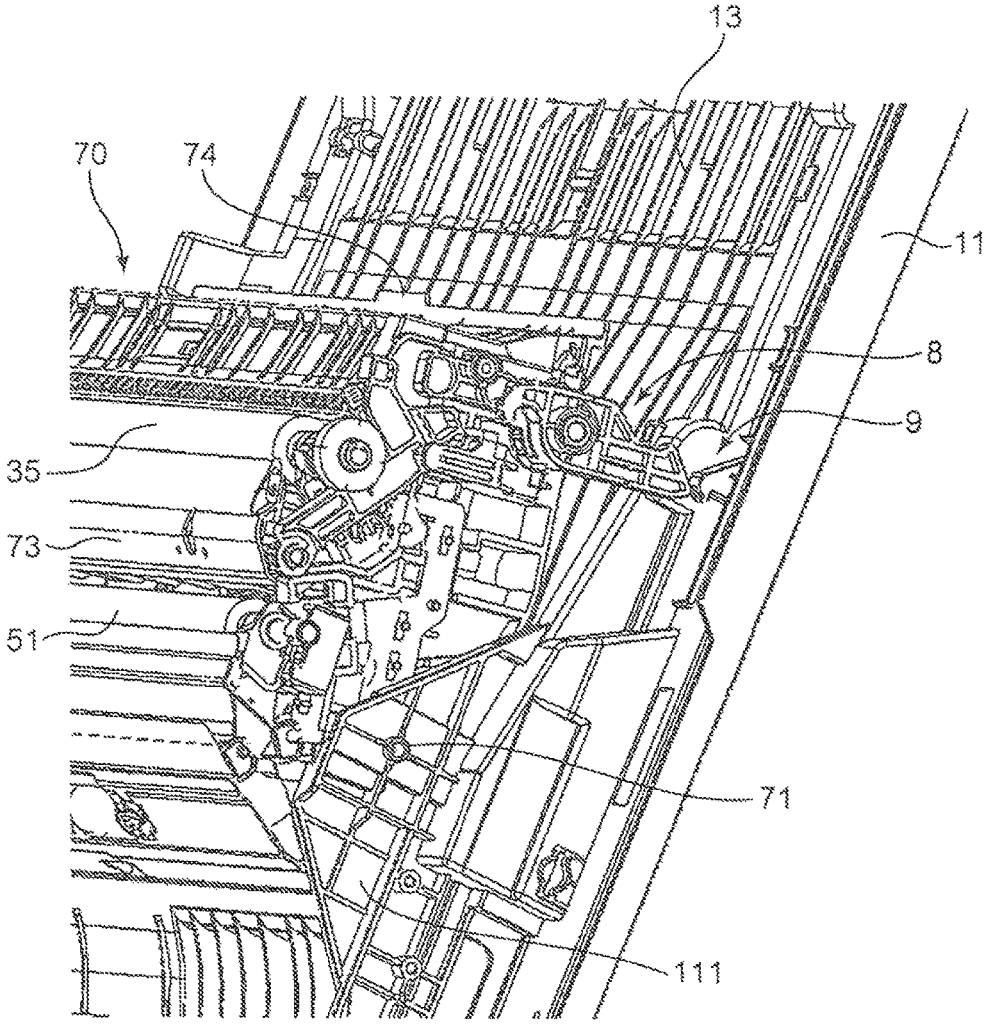
FIG. 6 is a perspective view of the conveyance cover and the conveyance unit, and is a diagram illustrating a first engaging portion provided to the conveyance cover and a second engaging portion attached to the conveyance unit.

The image forming apparatus 1 of this embodiment includes, in addition to the push back mechanism of the double-sided conveyance unit 70 described above, a mechanism for temporarily holding the pushed-back double-sided conveyance unit 70. As this temporarily holding mechanism, the image forming apparatus 1 includes a first engaging portion 9 and a second engaging portion 8. FIG. 6 is a perspective view of the conveyance cover 11 and the double-sided conveyance unit 70, and is a diagram illustrating the first engaging portion 9 provided to the conveyance cover 11 and the second engaging portion 8 attached to the double-sided conveyance unit 70.

The first engaging portion 9 is disposed on the width direction outer side of the first guide wall surface 13 of the conveyance cover 11. The second engaging portion 8 is disposed on the width direction outer side of the second guide wall surface 72 of the double-sided conveyance unit 70 at a position corresponding to the first engaging portion 9. This first engaging portion 9 and the second engaging portion 8 becomes a non-engaged state when the double-sided conveyance unit 70 is in the separated state, and becomes an engaged state when the same is in the normal state. In the state where the conveyance cover 11 is in the opened state and the double-sided conveyance unit 70 is in the separated state, when an operation of closing the conveyance cover 11 is performed so that the first abutment surface 64S and the second abutment surface 75S abut each other, thereby the double-sided conveyance unit 70 is pressed to switch from the separated state to the normal state as described above, the first engaging portion 9 and the second engaging portion 8 in the non-engaged state become engaged with each other.

In other words, the second abutment surface 75S abuts the first abutment surface 64S so that the double-sided conveyance unit 70 is pressed and pushed back to the normal state. Then, the second engaging portion 8 of the double-sided conveyance unit 70 fits in the first engaging portion 9 so that they are engaged with each other. Therefore, after the push back described above, at least the double-sided conveyance unit 70 can be temporarily held by the conveyance cover 11, and hence the user can perform the operation of switching the conveyance cover to the closed state more easily.

Figure 7:
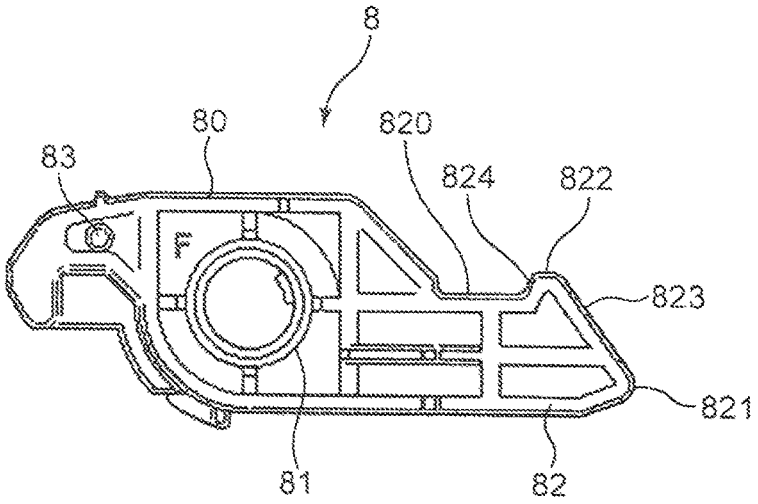
FIG. 7 is a side view of the second engaging portion.
Figure 8:
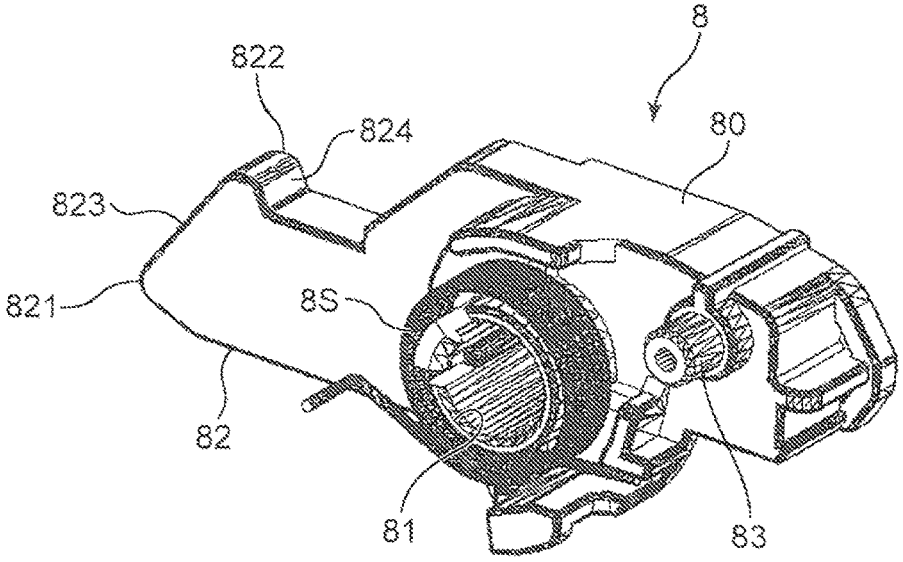
FIG. 8 is a perspective view of the second engaging portion.
Figure 9:
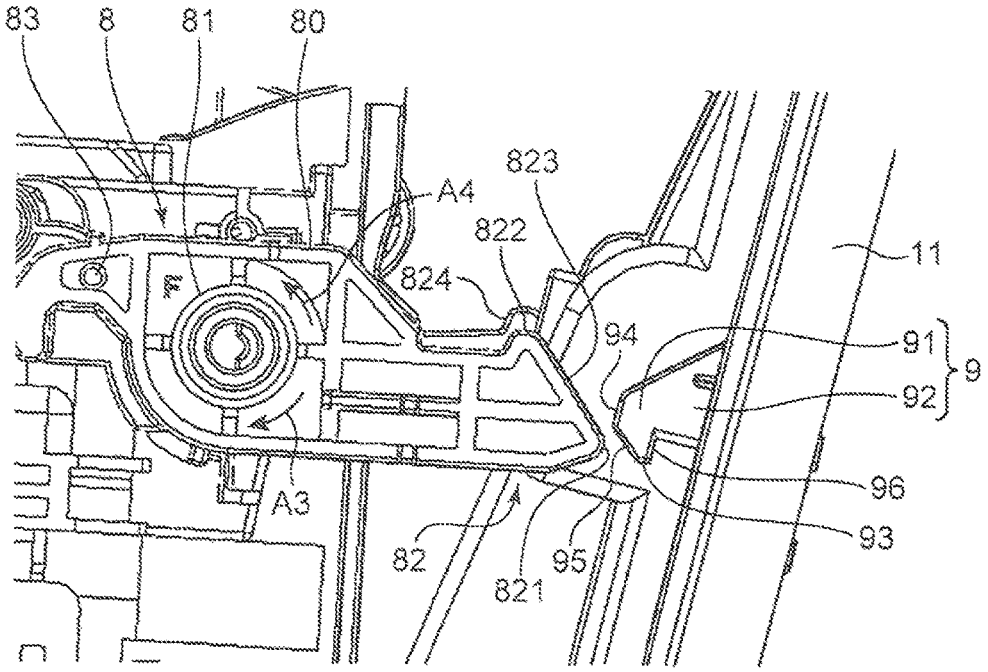
FIG. 9 is a side view illustrating an engaging operation between the first engaging portion and the second engaging portion.

The second engaging portion 8 and the first engaging portion 9 are described in detail. FIG. 7 is a side view of the second engaging portion 8, FIG. 8 is a perspective view of the second engaging portion 8, and FIG. 9 is a side view of the first engaging portion 9 and the second engaging portion 8, and is a diagram illustrating a state just before the two portions are engaged. The first engaging portion 9 has a first hook 91 disposed to protrude on a side closer to the double-sided conveyance unit 70 than the first guide wall surface 13 in a side view, and a base 92 supporting the first hook 91. The second engaging portion 8 is a member elongated in a horizontal direction in a side view, including a cylindrical bearing portion 81 disposed in a base 80 near the middle of the second engaging portion 8, a second hook 82 disposed on one end side of the base 80, and a link portion 83 disposed on the other end side of the base 80.

As illustrated in FIG. 9, the first hook 91 includes a lower end projection 93 most protruding downward, a side projection 94 most protruding sideward, a first inclined surface 95 (first interference portion) formed between the projections, and a first engagement edge 96 as a step portion of the lower end projection 93 and the base 92. An angle between a lower edge portion of the base 92 extending in the horizontal direction and the first engagement edge 96 is 90 degrees. In addition, an angle between the first inclined surface 95 and the first engagement edge 96 is approximately 45 degrees.

The bearing portion 81 of the second engaging portion 8 is fit in a cylindrical boss (not shown) disposed to protrude from the side surface of the double-sided conveyance unit 70. In this way, the second engaging portion 8 is supported by the double-sided conveyance unit 70 in a turnable manner about an axis of the bearing portion 81. The second hook 82 is a portion disposed to protrude from the base 80 toward the conveyance cover 11 side, and includes a protrusion base 820 extending from the bearing portion 81 in the horizontal direction, a side distal end 821 most protruding sideward, an upper projection 822 most protruding upward, a second inclined surface 823 (second interference portion) formed between them, and a second engagement edge 824 as a step portion of the upper projection 822 and the protrusion base 820. The second engagement edge 824 has an inclined surface that is nearly vertical, and the angle between an upper edge portion of the protrusion base 820 extending in the horizontal direction and the second engagement edge 824 is approximately 110 degrees as an example in this embodiment. The second engagement edge 824 is a portion that engages with the first engagement edge 96.

The link portion 83 is a cylindrical boss disposed to protrude from an inner surface of the base 80 as illustrated in FIG. 8. The link portion 83 is a member for link connection of the second engaging portion 8 to a link mechanism 84 (see FIG. 10) that moves the secondary transfer roller 35 to separate from the intermediate transfer belt 331. When the user operates an opening lever attached to the conveyance cover 11, the second engaging portion 8 rotates about the bearing portion 81 in the clockwise direction (arrow A3 direction in FIG. 9) by a link mechanism of the opening lever. Then, the link portion 83 is lifted up so that the link mechanism 84 is operated. By this operation, the secondary transfer roller 35 is separated from the intermediate transfer belt 331.

The second engaging portion 8 is provided with a torsion coil spring 8S (biasing member). The bearing portion 81 has a portion protruding from the inner surface of the base 80 as illustrated in FIG. 8. A body part of the torsion coil spring 8S is fit in this protruding portion of the bearing portion 81. The torsion coil spring 8S biases the second engaging portion 8 in an arrow A4 direction (first direction) for engaging with the first engaging portion 9 about the axis of the bearing portion 81.

The engaging operation between the second engaging portion 8 and the first engaging portion 9 is as follows. It is supposed that the user performs the operation of closing the conveyance cover 11, and the second abutment surface 75S abuts the first abutment surface 64S so that the double-sided conveyance unit 70 of the separated state is pressed and pushed back toward the normal state. In this case, the second engaging portion 8 is approaching the first engaging portion 9, and before the second engagement edge 824 engages with the first engagement edge 96, the second engaging portion 8 and the first engaging portion 9 interrupt with each other.

Figure 10:
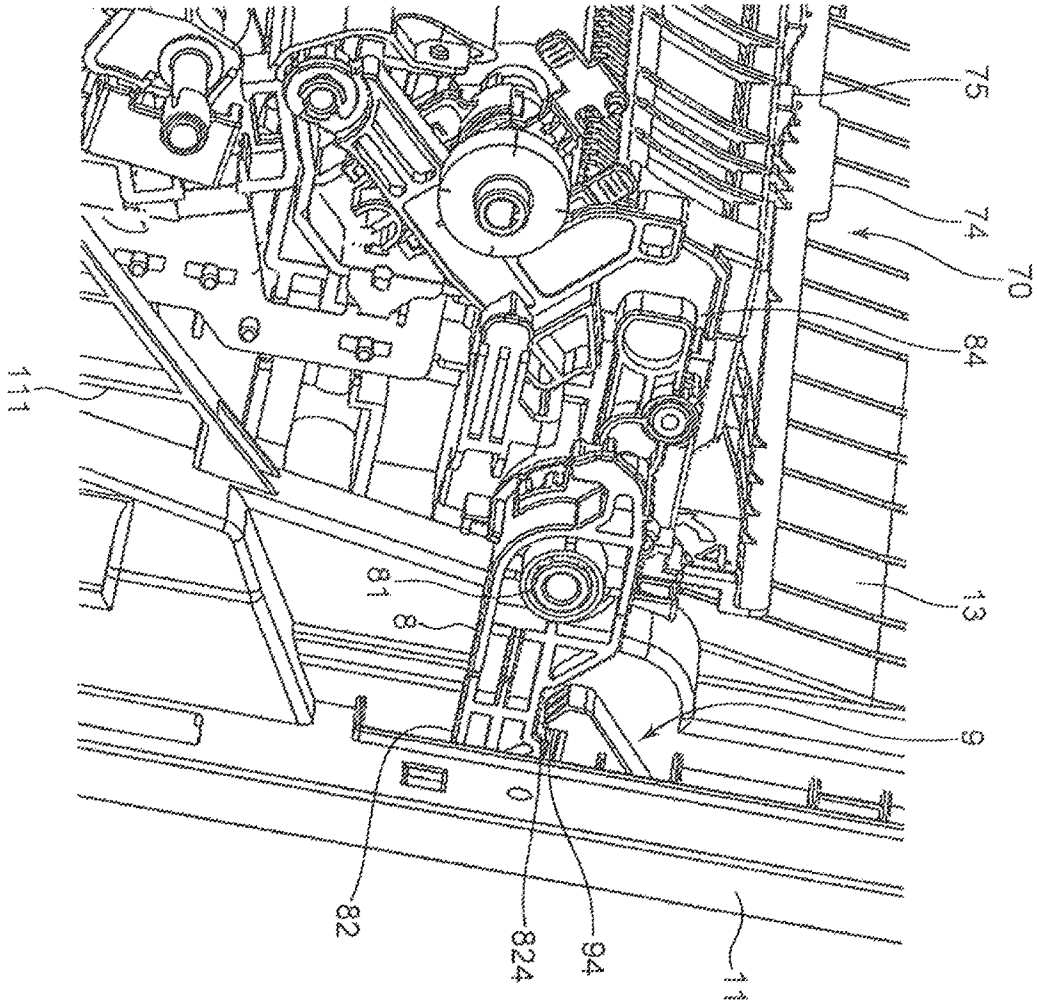
FIG. 10 is a perspective view illustrating a state where the first engaging portion is engaged with the second engaging portion.

FIG. 9 is a diagram illustrating the state just before the second engaging portion 8 and the first engaging portion 9 interrupt with each other, FIG. 10 is a diagram illustrating a state where the second engagement edge 824 of the second engaging portion 8 and the first engagement edge 96 of the first engaging portion 9 are engaged with each other. Just before the second engaging portion 8 and the first engaging portion 9 interrupt with each other, the second inclined surface 823 of the second engaging portion 8 and the first inclined surface 95 of the first engaging portion 9 become parallel to each other. When the double-sided conveyance unit 70 further turns from the state of FIG. 9 in the direction approaching the conveyance cover 11, the second inclined surface 823 collides to the first inclined surface 95 before long. The second inclined surface 823 collides to the lower end or its vicinity near the side distal end 821. This collision is made between parallel surfaces, which are inclined in the direction substantially along the turning locus of the double-sided conveyance unit 70, and hence it does not become a large load that prevents the turning of the double-sided conveyance unit 70.

After that, the second inclined surface 823 contacts with and slides to be guided on the first inclined surface 95 so that the second hook 82 is pushed downward. As described above, the second engaging portion 8 is biased by the torsion coil spring 8S in the arrow A4 direction. However, the second engaging portion 8 temporarily turns in the arrow A3 direction (second direction) opposite to the arrow A4 direction by the interruption with the first engaging portion 9 against the bias force of the torsion coil spring 8S.

As turning of the second engaging portion 8 in the arrow A3 direction proceeds, the upper end or its vicinity near the upper projection 822 of the second inclined surface 823 contacts with the first inclined surface 95. As turning further proceeds, the upper projection 822 runs over the lower end projection 93 of the first engaging portion 9 at last. Then, the first engagement edge 96 and the second engagement edge 824 face each other so that the second engaging portion 8 is engaged with the first engaging portion 9. FIG. 10 illustrates this engaged state. When reaching the engaged state, the biasing force of the torsion coil spring 8S turns the second engaging portion 8 in the arrow A4 direction (first direction).

In this way, as to the second engaging portion 8 and the first engaging portion 9, the second inclined surface 823 of the second hook 82 interrupts with the first inclined surface 95 of the first hook 91 in such a manner that the former is guided into the latter, and after the interruption the first engagement edge 96 and the second engagement edge 824 engage with each other. Therefore, even if the double-sided conveyance unit 70 moves toward the normal state by a slight force, the first hook 91 and the second hook 82 can engage with each other.

Further, the second engaging portion 8 has a structure in which the second engaging portion 8 is biased in the arrow A4 direction by the torsion coil spring 8S and interrupts with the first engaging portion 9 so as to temporarily turn in the arrow A3 direction against the biasing force. In this way, an impact generated when the second engaging portion 8 turns in the arrow A3 direction is absorbed. By providing this torsion coil spring 8S, the image forming apparatus 1 can have a damping effect for absorbing the impact generated when the first engaging portion 9 and the second engaging portion 8 are engaged, i.e. the impact when the conveyance cover 11 is closed.

As described above, the image forming apparatus 1 according to this embodiment has a structure in which in the state where the conveyance cover 11 is in the opened state and the double-sided conveyance unit 70 is in the separated state, when the operation of switching the conveyance cover 11 to the closed state is performed, the double-sided conveyance unit 70 and the side surface abut each other first with the first abutment surface 64S and the second abutment surface 75S, and by this abutment the double-sided conveyance unit 70 is pressed to move toward the normal state. Therefore, by the pressure when the conveyance cover 11 is switched from the opened state to the closed state, the attitude of the double-sided conveyance unit 70 is corrected to move toward the normal state, and hence the randomness of the movement locus of the double-sided conveyance unit 70 can be eliminated. In this way, freedom in design of the sheet conveyance path and its peripheral portion can be easily secured.

In addition, in the image forming apparatus 1 described above, it is preferred that the conveyance cover 11 be turnably supported at the lower part by the first fulcrum (first support shaft 12) provided to the body housing 10, and the double-sided conveyance unit 70 be turnably supported at the lower part by the second fulcrum (second support shaft 71) provided to the conveyance cover 11 at a position higher than the first fulcrum, and the second abutment surface 75S be disposed in the upper part of the double-sided conveyance unit 70.

According to this image forming apparatus 1, the second abutment surface 75S is disposed in the upper part of the double-sided conveyance unit 70, while the second fulcrum is disposed in the lower part of the double-sided conveyance unit 70. When the second abutment surface 75S abuts the first abutment surface 64S and is pressed by the same, it turns about the second fulcrum and is pushed back to the normal state. This structure is suitable for realizing the push back of the double-sided conveyance unit 70 by a small pressing force and improves user's operability of the conveyance cover 11.

In the image forming apparatus 1 described above, it is preferred that the second abutment surface 75S be a flat abutment surface parallel to the side surface when the conveyance unit is in the normal state, and the first abutment surface 64S be a flat reception surface that can make surface contact with the flat abutment surface.

According to the image forming apparatus 1, it is possible to prevent an impact force from concentrating locally when the first abutment surface 64S and the second abutment surface 75S abut each other, and hence breakage due to the abutment can be prevented.

In the image forming apparatus 1 described above, it is preferred that the conveyance cover 11 include the first engaging portion 9 disposed on the width direction outer side of the first guide wall surface 13, the double-sided conveyance unit 70 be disposed on the width direction outer side of the second guide wall surface 72 at a position corresponding to the first engaging portion 9, the second engaging portion 8 that can engage with the first engaging portion 9 be provided, the first engaging portion 9 and the second engaging portion 8 be in the non-engaged state when the double-sided conveyance unit 70 is in the separated state while be in the engaged state when the same is in the normal state, and when the double-sided conveyance unit 70 is pressed to move from the separated state toward the normal state by the abutment between the first abutment surface 64S and the second abutment surface 75S, the first engaging portion 9 and the second engaging portion 8 in the non-engaged state engage with each other.

According to this image forming apparatus 1, when the second abutment surface 75S abuts the first abutment surface 64S so that the double-sided conveyance unit 70 is pressed and pushed back to the normal state, the first engaging portion 9 and the second engaging portion 8 can engage with each other. Therefore, after the push back described above, at least the double-sided conveyance unit 70 can be temporarily held by the conveyance cover 11, and hence the user can perform the operation of switching the conveyance cover 11 to the closed state more easily.

In the image forming apparatus 1 described above, it is preferred that the first engaging portion 9 include the first hook 91 disposed to protrude toward the double-sided conveyance unit 70 side, the second engaging portion 8 include the second hook 82 disposed to protrude toward the conveyance cover 11 side, the first hook 91 include the first engagement edge 96, the second hook 82 include the second engagement edge 824, the first interference portion of the first hook 91 and the second interference portion of the second hook 82 interrupt with each other before the first engagement edge 96 and the second engagement edge 824 engage with each other, the first interference portion be the first inclined surface 95 that guides the second engagement edge 824 into the first engagement edge 96, and the second interference portion be the second inclined surface 823 that becomes parallel to the inclined surface just before the interruption.

According to this image forming apparatus 1, the second inclined surface 823 of the second hook 82 and the first inclined surface 95 of the first hook 91 interrupt with each other in such a manner that the former is guided into the latter, and the first engagement edge 96 and the second engagement edge 824 engage with each other after the interruption. Therefore, even if the double-sided conveyance unit 70 moves toward the normal state by a slight force, the first hook 91 and the second hook 82 can engage with each other.

In the image forming apparatus 1 described above, it is preferred that the second engaging portion 8 be axially-turnably supported by the double-sided conveyance unit 70, the biasing member (torsion coil spring 8S) that biases the second engaging portion 8 in the first direction to engage with the first engaging portion 9 about an axis be further provided, the second engaging portion 8 temporarily turns in the second direction opposite to the first direction by interruption with the first engaging portion 9 just before the first engaging portion 9 and the second engaging portion 8 engage with each other, and the biasing member further have a function of absorbing an impact generated when the second engaging portion 8 temporarily turns in the second direction.

According to this image forming apparatus 1, by providing the biasing member, the image forming apparatus 1 can have a damping effect for absorbing the impact generated when the first engaging portion 9 and the second engaging portion 8 are engaged.

In the image forming apparatus 1 described above, it is preferred that the body housing 10 include the main conveyance path 50A for conveying the sheet via the image forming unit 32, and the reverse conveyance path 50B for conveying the sheet back to the upstream side of the image forming unit 32 when performing double-sided printing, and the sheet conveyance path be the reverse conveyance path 50B.

Although the image forming apparatus 1 according to the embodiment of the present invention is described above, the present invention is not limited to this. For example, it is possible to adopt the following modified embodiments.

(1) The embodiment described above exemplifies the case where the first abutment surface 64S is the bottom surface of the recess 64 disposed near the middle in the width direction of the right side wall 63 of the fixing housing 60H. Other than that, the first abutment surface 64S may be a distal end surface of a protrusion, for example. In addition, a plurality of first abutment surfaces 64S may be disposed at appropriate positions on the right side surface 10R of the body housing 10. In addition, the second abutment surface 75S is a surface of the protrusion 75 disposed on the upper surface of the double-sided conveyance unit 70 in the example described above. This is merely an example, and it may be a bottom surface of a recess if the first abutment surface 64S is the distal end surface of the protrusion for example.

(2) A cushioning material for relaxing the impact due to collision between the first abutment surface 64S and the second abutment surface 75S may be adhered to at least one of them. The cushioning material may be a rubber sheet member or a foaming sheet member made of silicone rubber or the like, for example.

(3) In the embodiment described above, the reverse conveyance path 50B is shown as an example of the sheet conveyance path. This is an example, and there is no limitation to the sheet conveyance path as long as it is formed between the conveyance cover 11 and the conveyance unit turnable with respect to the conveyance cover 11.

The invention claimed is:

1. An image forming apparatus comprising:

an image forming unit configured to form an image on a sheet;

a sheet conveyance path constituted of a first wall and a second wall disposed to face each other with a predetermined space therebetween, so as to convey the sheet in a vertical direction;

a body housing configured to house the image forming unit and the sheet conveyance path, and to have a side surface to be an access surface when the sheet conveyance path is opened to the outside;

a conveyance cover having an outer wall surface and an inner wall surface, turnably mounted to the body housing on the side surface, including a first guide wall surface constituting at least a part of the first wall on the inner wall surface side, so that attitude thereof is switchable between a closed state in which the sheet conveyance path is closed and an opened state in which the sheet conveyance path is opened to the outside; and a conveyance unit disposed on the inner wall surface side of the conveyance cover and turnably mounted to the conveyance cover, including a second guide wall surface constituting at least a part of the second wall, so that attitude thereof is switchable between a normal state in which the second guide wall surface faces the first guide wall surface with a predetermined space therebetween to form at least a part of the sheet conveyance path, and a separated state in which the second guide wall surface is separated from the first guide wall surface, wherein the side surface of the body housing is provided with a first abutment surface, the conveyance unit is provided with a second abutment surface capable of abutting the first abutment surface, and in a state where the conveyance cover is in the opened state and the conveyance unit is in the separated state, when an operation of switching the conveyance cover to the closed state is performed, the conveyance unit and the side surface abut each other first with the first abutment surface and the second abutment surface, and by this abutment the conveyance unit is pressed to move toward the normal state.

2. The image forming apparatus according to claim 1, wherein the conveyance cover is turnably supported at a lower part thereof by a first fulcrum provided to the body housing, the conveyance unit is turnably supported at a lower part thereof by a second fulcrum provided to the conveyance cover at a position higher than the first fulcrum, and the second abutment surface is disposed at an upper part of the conveyance unit.

3. The image forming apparatus according to claim 2, wherein the second abutment surface is a flat abutment surface parallel to the side surface when the conveyance unit is in the normal state, and the first abutment surface is a flat reception surface capable of making surface contact with the flat abutment surface.

4. The image forming apparatus according to claim 2, wherein the conveyance cover includes a first engaging portion disposed on a width direction outer side of the first guide wall surface, the conveyance unit includes a second engaging portion disposed on the width direction outer side of the second guide wall surface at a position corresponding to the first engaging portion, the second engaging portion being capable of engaging with the first engaging portion, the first engaging portion and the second engaging portion become a non-engaged state when the conveyance unit is in the separated state and become an engaged state when the conveyance unit is in the normal state, and when the first abutment surface and the second abutment surface abut each other so that the conveyance unit is pressed to move from the separated state toward the normal state, the first engaging portion and the second engaging portion in the non-engaged state engage each other.

5. The image forming apparatus according to claim 4, wherein the first engaging portion includes a first hook disposed to protrude toward the conveyance unit side, the second engaging portion includes a second hook disposed to protrude toward the conveyance cover side, the first hook has a first engagement edge while the second hook has a second engagement edge, so that a first interference portion of the first hook and a second interference portion of the second hook interrupt with each other before the first engagement edge and the second engagement edge engage with each other, the first interference portion is a first inclined surface configured to guide the second engagement edge into the first engagement edge, and the second interference portion is a second inclined surface configured to be parallel to the inclined surface just before the interruption.

6. The image forming apparatus according to claim 4, wherein the second engaging portion is supported by the conveyance unit turnably about an axis, a biasing member is further provided so as to bias the second engaging portion in a first direction to engage with the first engaging portion about the axis, the second engaging portion temporarily turns in a second direction opposite to the first direction by interruption with the first engaging portion just before the first engaging portion and the second engaging portion engage with each other, and the biasing member further has a function of absorbing an impact generated when the second engaging portion temporarily turns in the second direction.

7. The image forming apparatus according to claim 1, wherein the body housing includes a main conveyance path for conveying the sheet via the image forming unit, and a reverse conveyance path for conveying the sheet back to an upstream side of the image forming unit when performing double-sided printing, and the sheet conveyance path is the reverse conveyance path.

8. The image forming apparatus according to claim 1, wherein the conveyance cover is turnably supported at a lower part thereof by a first fulcrum provided to the body housing, the conveyance unit is turnably supported at a lower part thereof by a second fulcrum provided to the conveyance cover at a position higher than the first fulcrum, the second abutment surface is disposed at an upper part of the conveyance unit, the second abutment surface is a flat abutment surface parallel to the side surface when the conveyance unit is in the normal state, the first abutment surface is a flat reception surface capable of making surface contact with the flat abutment surface, the conveyance cover includes a first engaging portion disposed on a width direction outer side of the first guide wall surface, the conveyance unit includes a second engaging portion disposed on the width direction outer side of the second guide wall surface at a position corresponding to the first engaging portion, the second engaging portion being capable of engaging with the first engaging portion, the first engaging portion and the second engaging portion become a non-engaged state when the conveyance unit is in the separated state and become an engaged state when the conveyance unit is in the normal state, when the first abutment surface and the second abutment surface abut each other so that the conveyance unit is pressed to move from the separated state toward the normal state, the first engaging portion and the second engaging portion in the non-engaged state engage each other, the first engaging portion includes a first hook disposed to protrude toward the conveyance unit side, the second engaging portion includes a second hook disposed to protrude toward the conveyance cover side, the first hook has a first engagement edge while the second hook has a second engagement edge, so that a first interference portion of the first hook and a second interference portion of the second hook interrupt with each other before the first engagement edge and the second engagement edge engage with each other, the first interference portion is a first inclined surface configured to guide the second engagement edge into the first engagement edge, the second interference portion is a second inclined surface configured to be parallel to the inclined surface just before the interruption, the second engaging portion is supported by the conveyance unit turnably about an axis, a biasing member is further provided so as to bias the second engaging portion in a first direction to engage with the first engaging portion about the axis, the second engaging portion temporarily turns in a second direction opposite to the first direction by interruption with the first engaging portion just before the first engaging portion and the second engaging portion engage with each other, the biasing member further has a function of absorbing an impact generated when the second engaging portion temporarily turns in the second direction, the body housing includes a main conveyance path for conveying the sheet via the image forming unit, and a reverse conveyance path for conveying the sheet back to an upstream side of the image forming unit when performing double-sided printing, and the sheet conveyance path is the reverse conveyance path.

* * * * *